US011140920B2

(12) United States Patent
Eweidah

(10) Patent No.: US 11,140,920 B2
(45) Date of Patent: Oct. 12, 2021

(54) COMPACT SIZED VAPING DEVICE WITH A CHILD PROOFING MECHANISM

(71) Applicant: AISLEYMORE CORPORATION N.V, Willemstad (CW)

(72) Inventor: Fadi Eweidah, Richmond Hill (CA)

( * ) Notice: Subject to any disclaimer, the term of this patent is extended or adjusted under 35 U.S.C. 154(b) by 443 days.

(21) Appl. No.: 16/184,990

(22) Filed: Nov. 8, 2018

(65) Prior Publication Data

US 2019/0166910 A1 Jun. 6, 2019

(30) Foreign Application Priority Data

Nov. 9, 2017 (GB) ..... 1718570

(51) Int. Cl.

| | |
|---|---|
| ***A24F 40/49*** | (2020.01) |
| ***A24F 40/40*** | (2020.01) |
| ***A24F 40/90*** | (2020.01) |
| ***A24F 40/10*** | (2020.01) |

(52) U.S. Cl.

CPC ..... *A24F 40/49* (2020.01); *A24F 40/40* (2020.01); *A24F 40/90* (2020.01); *A24F 40/10* (2020.01)

(58) Field of Classification Search

CPC ..... A24F 40/49; A24F 40/40

See application file for complete search history.

(56) References Cited

U.S. PATENT DOCUMENTS

| | | | |
|---|---|---|---|
| 1,160,982 | A | 11/1915 | Hammer |
| 1,351,496 | A | 8/1920 | Spooner |
| 3,101,856 | A | 8/1963 | Whiteman, Jr. |
| 3,140,799 | A | 7/1964 | Mehr |
| 3,151,599 | A | 10/1964 | Livingston |
| 3,260,423 | A | 7/1966 | Fillmore et al. |
| 3,656,646 | A | 4/1972 | Taylor |
| 3,757,979 | A | 9/1973 | Beghahn |
| 3,944,114 | A | 3/1976 | Coppens |
| 4,117,949 | A | 10/1978 | Dwinell |
| 4,128,184 | A | 12/1978 | Northrup |
| 4,156,489 | A | 5/1979 | Kong |
| 4,383,619 | A | 5/1983 | Mumford et al. |
| 4,789,057 | A | 12/1988 | Fisher |
| 7,111,746 | B2 | 9/2006 | Miceli et al. |
| 8,051,999 | B2 | 11/2011 | Carmody et al. |
| 2018/0360125 | A1* | 12/2018 | James ..... A61M 11/042 |

FOREIGN PATENT DOCUMENTS

CN 206507314 U * 9/2017

OTHER PUBLICATIONS

English translation of CN 206507314 (Year: 2021).*

* cited by examiner

*Primary Examiner* — Eric Yaary
*Assistant Examiner* — Jennifer A Kessie

(57) ABSTRACT

A compact vaping device with a child proofing mechanism is provided. The vaping device includes a mouthpiece, battery, vaping liquid pod cartridge, and heating coil. During operation, a user takes a drag on the mouthpiece, the battery heats up the coil which turns the liquid into vapor which may be inhaled by the user. The child proofing mechanism provides solutions preventing the tamper and unauthorized use of the device.

12 Claims, 7 Drawing Sheets

COMPACT SIZED VAPING DEVICE WITH A CHILD PROOFING MECHANISM

CROSS-REFERENCE TO RELATED APPLICATIONS

The present application claims priority to United Kingdom Patent Application serial number GB1718570.3, filed on Nov. 9, 2017 entitled "COMPACT SIZED VAPING DEVICE", the disclosure of which is hereby incorporated in its entirety at least by reference.

BACKGROUND OF THE INVENTION

1. Field of the Invention

The present invention generally relates to vaping hardware but more particularly to a compact sized vaping device with a child proofing mechanism.

2. Description of Related Art

Vaping is the act of inhaling and exhaling the aerosol produced by an electronic device called vaporizer or e-cigarettes, and has become more and more popular since the beginning of this century as an alternative to smoking cigarettes. Vaping proponents say that the health hazards are much reduced in comparison to smoking combustible cigarettes. A special nicotine-containing liquid is vaporized by way of an electric heater, and in gaseous form it is inhaled and exhaled by the user. The vapor usually looks more dense than smoke, but dissipates more quickly into the air and smells much better, depending upon the flavoring used in the liquid mixture. Vaporizers can trace their origins to the hookah, or water smoke pipe which has been used for centuries. The modern vaping device was originally invented in the 1960s but revived early in the 2000s by Hon Like, a Chinese pharmacist. Although nicotine and other compounds inhaled into the lungs via vaporization can be tolerated to certain concentrations, the nicotine or other compounds such as cannabis extracts in their liquid form can be highly toxic to the human body. Current vaporizer inventions lack a method of preventing the disposable liquid containing pods from being removed from the vaporizer devices and being ingested by infants or children, which can pose the risk of serious injury or death.

BRIEF SUMMARY OF THE INVENTION

In one embodiment a compact vaping device with a child proofing mechanism is provided, comprising: a casing having a rotatable lid, wherein the casing includes an internal cavity having a front portion; a battery; a heating coil; a co-joined removable mouthpiece and pod configured to attach inside the front portion of the internal cavity, wherein the pod contains a substance configured to be heated via the heating coil turning the substance into a vapor as it passes through the mouthpiece; and, a push-hole forming part of the casing, the push-hole exposing the pod, wherein a predetermined pressure against the pod through the push-hole is required to remove the pod from the casing.

In one embodiment, the casing is round and includes a flat top surface and a flat bottom surface. In one embodiment, the battery is rechargeable and the combination of the flat bottom surface and the rechargeable battery make the compact vaping device enabled for wireless induction charging. In another embodiment, wherein the pod is securely held inside the front portion of the casing via a pair of spring loaded tabs frictionally engaged with bulged pads on the outer surface of the pod. In one embodiment, the predetermined pressure must overcome the engagement of the pair of spring loaded tabs frictionally engaged with the bulged pods for removal of the pod from the casing. In yet another embodiment, a spring loaded plunger on the rotatable lid is provided, wherein the spring loaded plunger is configured to seat inside a cavity positioned on the front portion of the casing. In one embodiment, the rotation of the rotatable lid is via a hidden revolute joint and the rotation of the rotatable lid must overcome a predetermined retention force to rotate open, wherein the predetermined retention force is the force necessary to remove the spring loaded plunger from the cavity. In another embodiment, a communication port configured for charging the battery via a wired means is provided.

In another aspect of the invention, a compact vaping device with a child proofing mechanism is provided, comprising: a round casing having a flat top surface and a flat bottom surface, wherein the round casing includes an internal cavity having a front portion; a rotatable lid having retention characteristics configured to prevent the rotatable lid from being opened by a child; a battery retained in an internal body, the internal body configured to be positioned inside the internal cavity; a heating coil; a co-joined removable mouthpiece and pod configured to securely attach inside the front portion of the internal cavity, wherein the pod contains a substance configured to be heated via the heating coil turning the substance into a vapor as it passes through the mouthpiece; and, a push-hole forming part of the casing, the push-hole exposing the pod, wherein a predetermined pressure against the pod through the push-hole is required to remove the pod from the casing.

In one embodiment, the retention characteristics includes a spring loaded plunger on the rotatable lid, wherein the spring loaded plunger is configured to seat inside a cavity positioned on the front portion of the casing. In another embodiment, the rotation of the rotatable lid is via a hidden revolute joint and the rotation of the rotatable lid must overcome a predetermined retention force to rotate open, wherein the predetermined retention force is the force necessary to remove the spring loaded plunger from the cavity. In yet another embodiment, the retention characteristics further includes a set of magnets positioned on the rotatable lid, wherein the set of magnets are in magnetic connection with magnetic elements on the internal body providing an additional predetermined retention force to rotate the rotatable lid open.

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF THE PREFERRED EMBODIMENT

The following description is provided to enable any person skilled in the art to make and use the invention and sets forth the best modes contemplated by the inventor of carrying out their invention. Various modifications, however, will remain readily apparent to those skilled in the art, since the general principles of the present invention have been defined herein to specifically provide a compact sized vaping device with a child proofing mechanism.

Figure 1:
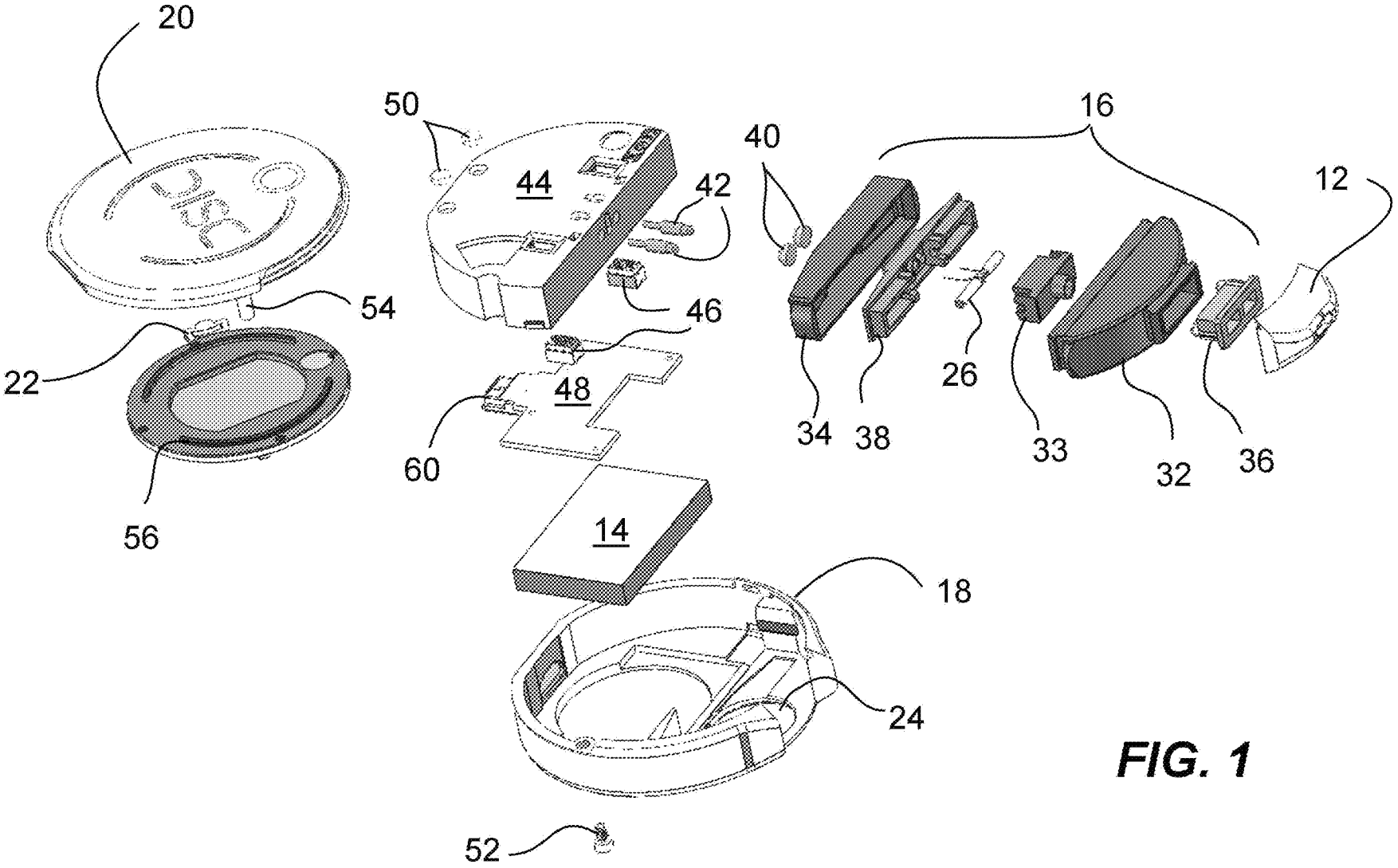
FIG. 1 is an exploded view of a compact sized vaping device with a child proofing mechanism according to an embodiment of the present invention.
Figure 2A:
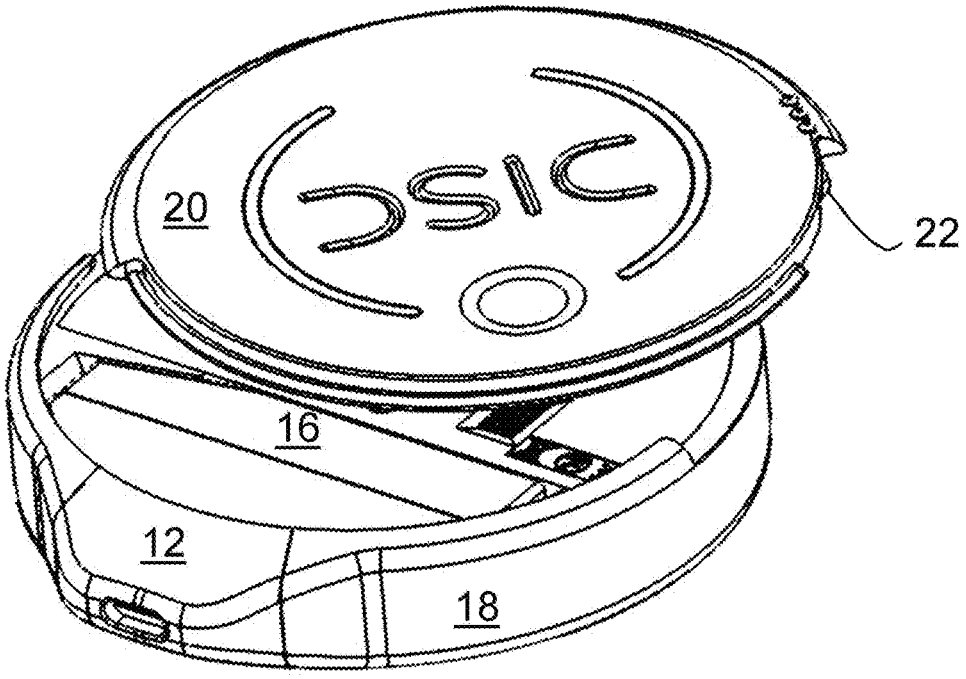
FIG. 2A an isometric view of the compact sized vaping device with a child proofing mechanism showing the lid partially open and the cartridge inserted according to an embodiment of the present invention.
Figure 2B:
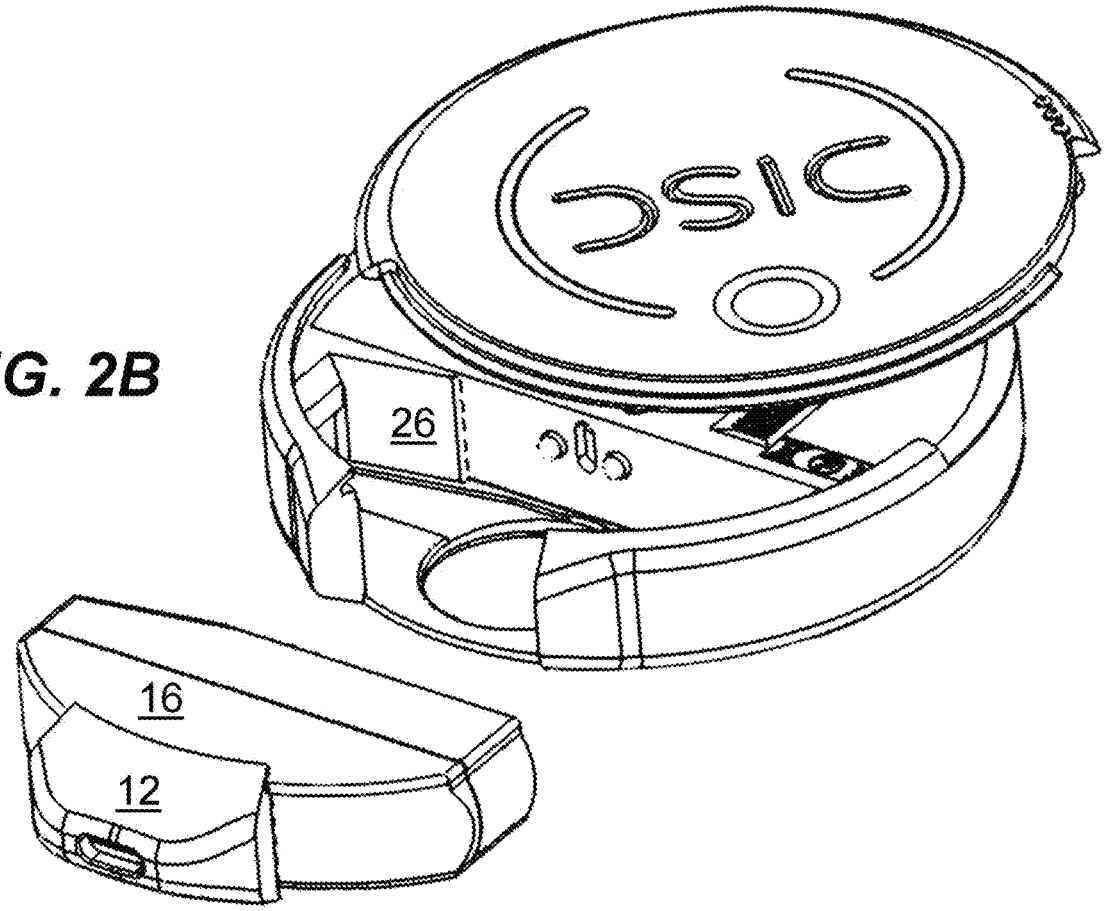
FIG. 2B an isometric view of the compact sized vaping device with a child proofing mechanism showing the lid partially open and the cartridge removed according to an embodiment of the present invention.
Figure 3A:
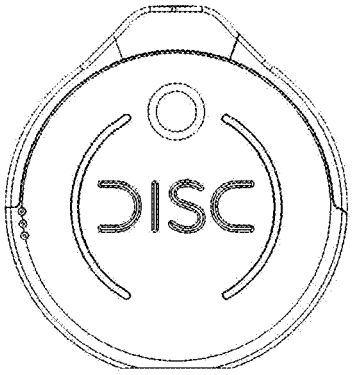
FIGS. 3A-B are top and bottom perspective views of the compact sized vaping device with a child proofing mechanism respectively according to an embodiment of the present invention.
Figure 3B:
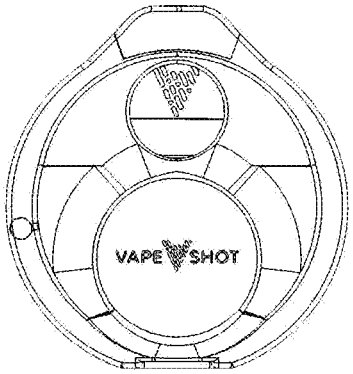
Figure 4A:
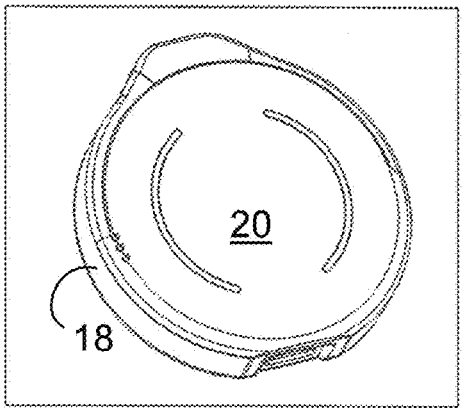
FIGS. 4A-G are isometric views illustrated the steps required for removing the pod according to an embodiment of the present invention.
Figure 4B:
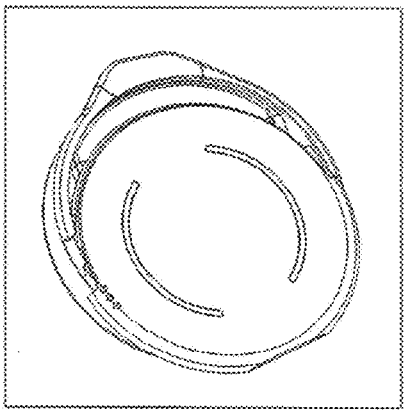
Figure 4C:
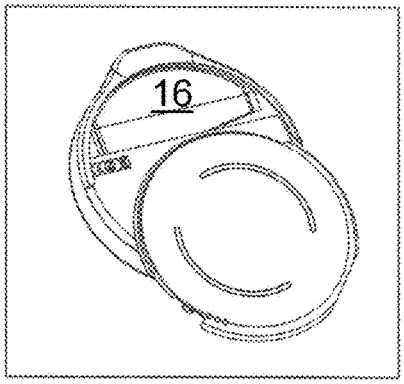
Figure 4D:
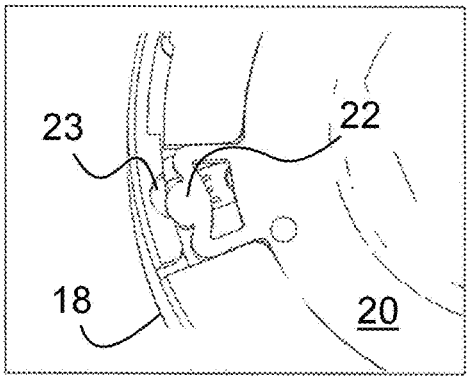
Figure 4E:
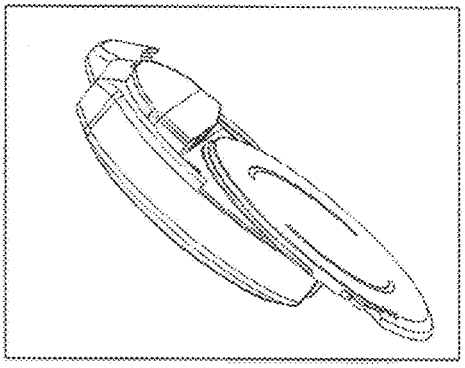
Figure 4F:
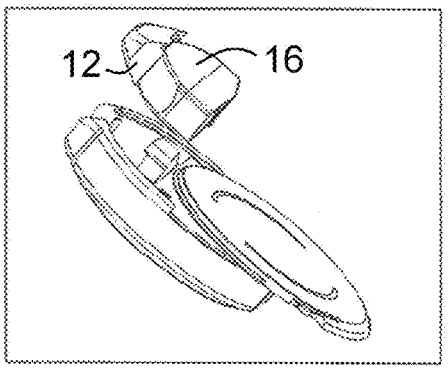
Figure 4G:
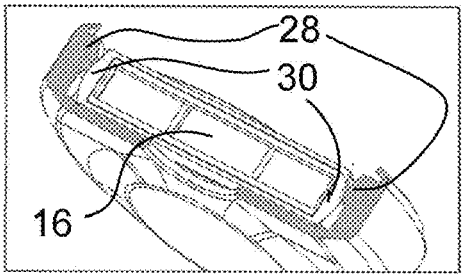
Figure 5:
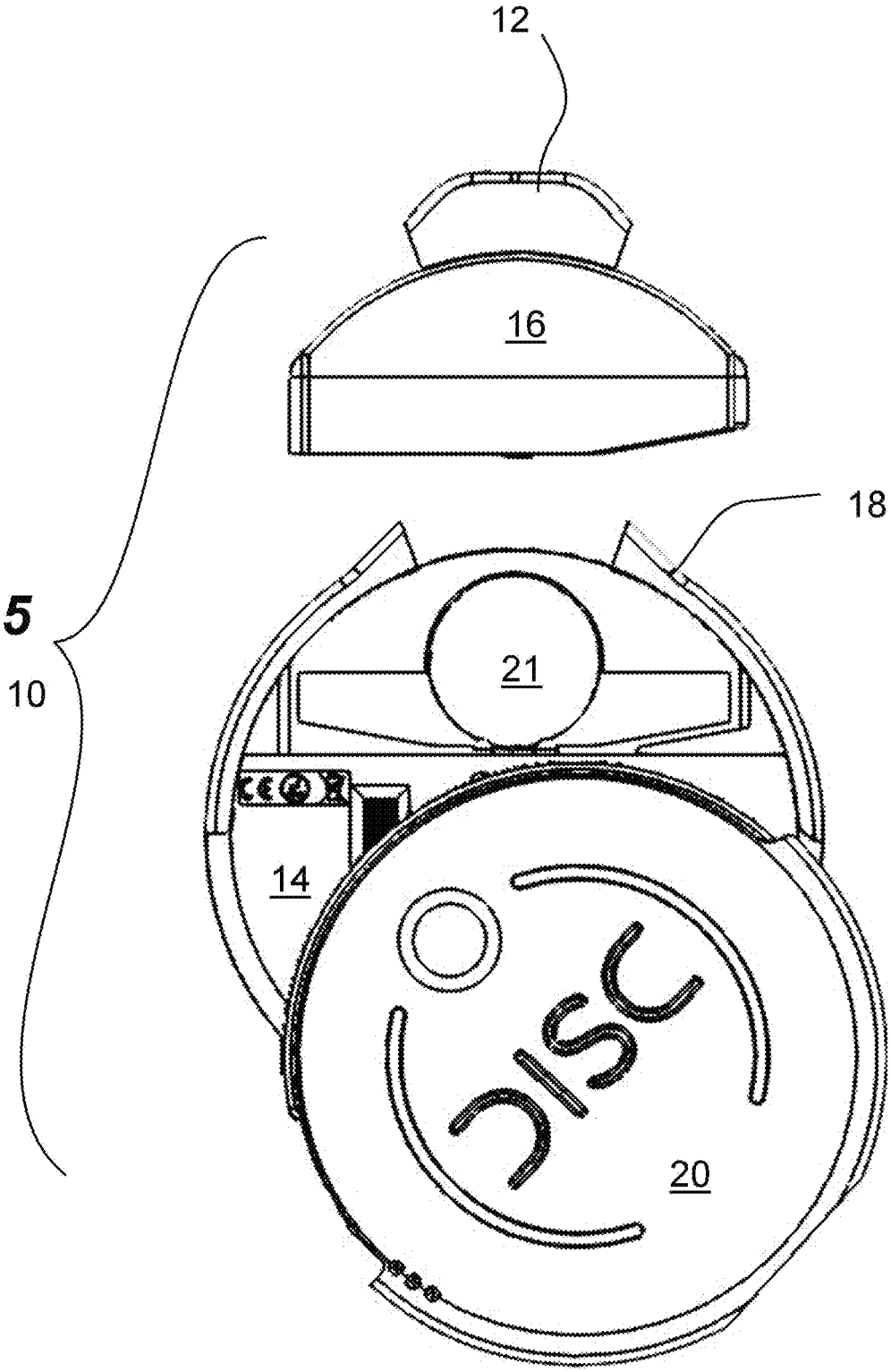
FIG. 5 is a top perspective view of the compact sized vaping device with a child proofing mechanism showing the lid partially open according to an embodiment of the present invention.
Figure 6:
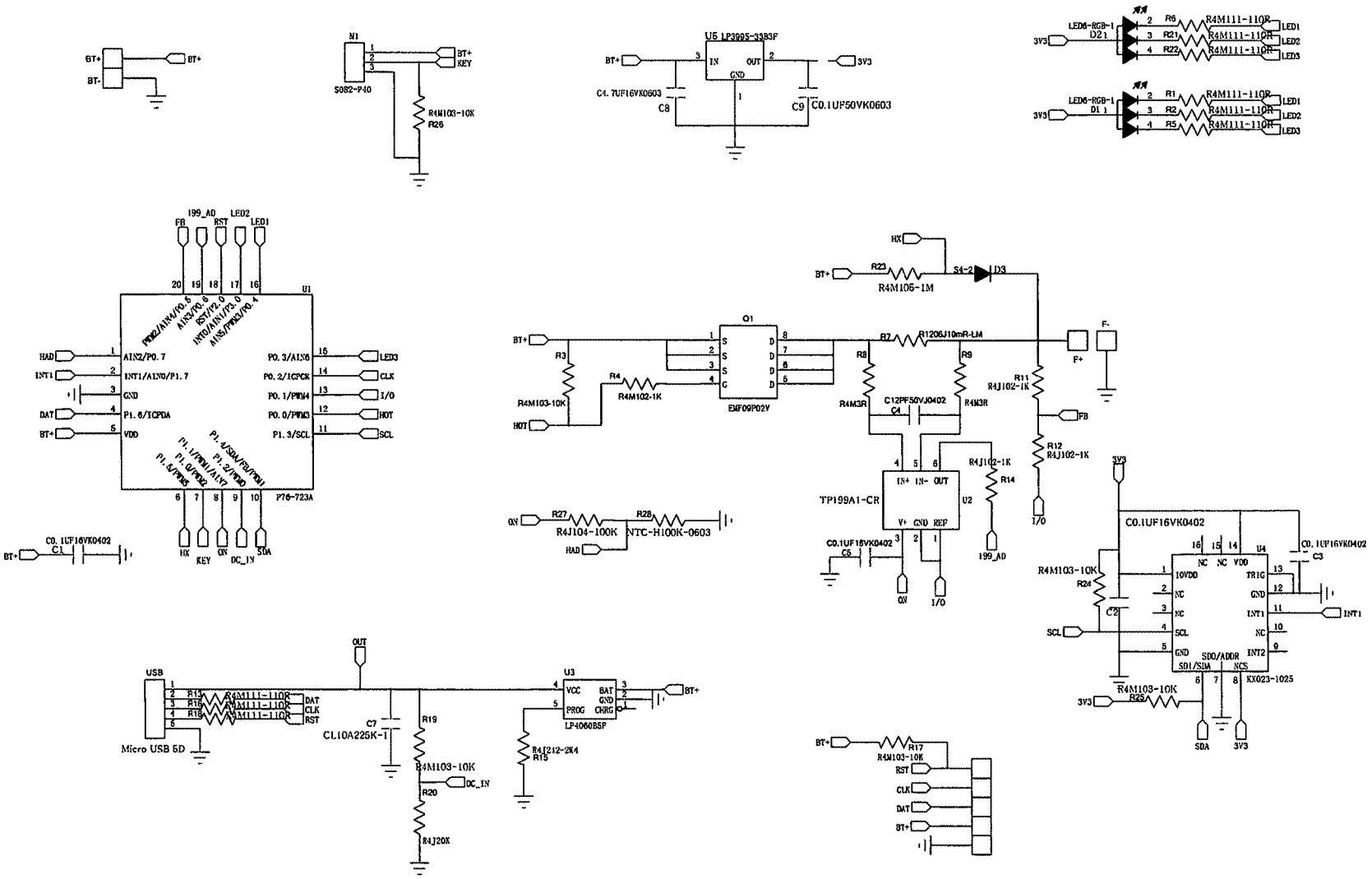
FIG. 6 is a schematic view of the electrical system according to an embodiment of the present invention.
Figure 7:
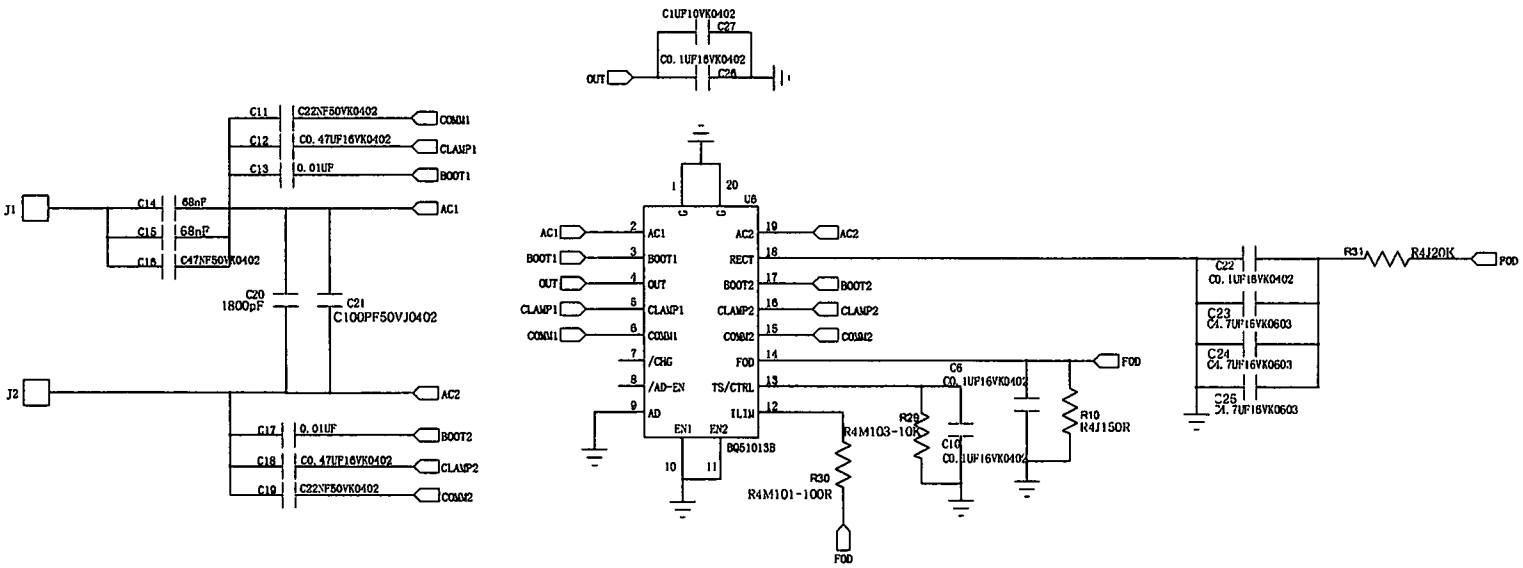
FIG. 7 is a schematic view of the micro controller according to an embodiment of the present invention.

Referring now to any of the accompanying FIGS. 1-5, a compact sized vaping device with a child proofing mechanism 10 is illustrated. The vaping device comprises a round casing 18 having a rotatable lid 20. The round casing includes a flat top surface (rotatable lid; best seen in FIG. 3A) and a flat bottom surface (best seen in FIG. 3B). Advantageously, the shape of the casing the flat bottom surface makes the compact sized vaping device suitable for wireless charging (induction charging). This provides an advantage compared to the common cylindrical shaped vape pens, which are not suitable for wireless charging.

Further, the vaping device comprises a removable mouthpiece 12 and pod 16 configured to attach inside a front portion casing of the vaping device. When inside the casing, the pod is positioned against heating coil 26. As well known in the art, the pod contains the substance to be vaporized via the heating coil. In one embodiment, as a user inhales on the mouthpiece, the heating coil heats up turning the substance into a vapor as it passes through the mouthpiece, wherein the vapor may be inhaled by the user. In one embodiment, the mouthpiece and pod are co-joined. In one embodiment, the rotatable lid allows the internal components of the casing to be accessed, such that the user can insert or remove the pod.

In one embodiment, the pod comprising a pod cap 34 and a pod shell 32 configured to house the components of the pod, including a gasket 36 for sealing between the mouthpiece and the pod shell, as well as a chimney 33 to direct vapor towards the mouthpiece. The gasket 36 is made with a polymer and mates with the hard plastic surface of the pod shell 32, preventing leakage and seepage of the liquid. The chimney is also made of a polymer, allowing flexibility under ambient pressure fluctuations (such as aboard aircraft during transit at high altitudes where sea level atmospheric pressure cannot be maintained), which prevents liquid from escaping under partial vacuum. A pod plug 38 seals the opposite side of the pod adjacent to the pod cap. In one embodiment, pogo pins 42 in electrical contact with the poles of the battery are in electrical connection with heating coil 26 via contactors 40 through a temperature regulating circuit. In one embodiment, the casing includes an internal body 44 housing indicator LEDs 46, battery 14, and a PCB 48. In one embodiment, the rotatable lid includes LED diffusers 56 which diffuse the light emanating from the indicator LEDs.

It is a particular advantage of the present invention to provide a child proof mechanism. In one embodiment, a spring loaded plunger 22 is provided on the rotatable lid. As the user rotates the lid, the spring loaded plunger is forcibly removed from cavity 23, wherein the rotation is of the lid is via a hidden revolute joint. In one embodiment, the revolute joint includes mechanical fastener 52 connected to peg 54 extending perpendicularly from the interior side of the rotatable lid. In one embodiment, the cavity is located in the front portion of the casing. The spring loaded plunger requires significant retention force, thus making the lid difficult to open for a child. In one embodiment, the rotatable lid and internal body includes magnets 50 configured to provide additional retention characteristics so as to further increase resistance in the opening process. However, there are more child proof mechanisms which will be described in greater detail below.

After the rotatable lid is successfully opened, the user is required to insert one finger through push-hole 24 in order to push the pod out of the casing. In one embodiment, the pod is securely held in place by way of a pair of spring loaded tabs 28 frictionally engaged with bulged pads 30. Advantageously, this requires a predetermined amount of pressure from the one finger in order to successfully disengage the pod. Thus, with the combination of the force required to remove the spring loaded plunger from the cavity, dexterity required inserting a finger through the push-hole, and the force required to disengage the pod makes it virtually impossible for a child to tamper with the device, thereby preventing accidental ingestion of the substance. Further, the use of the finger through the push-hole is via the bottom of the device, thus the device must be in a different orientation than when removing the rotatable lid, making the device even more difficult to tamper with for a child.

In one embodiment, the push-hole also provides a means to determine how much substance is left in the pod, as the push-hole exposes the pod shell. In the preferred embodiment, the substance is a concentrated liquid containing nicotine. As previously mentioned, battery compartment 14 may include a rechargeable battery configured to be recharged by wireless means, such as via a wireless charging pad via an induction coil feature. In alternative embodiments, the battery may be a rechargeable battery configured to be recharged by wired means, or a non-rechargeable battery may be utilized. If a wired charging is desired, a USB or generic communications port 60 may be used for charging. The battery provides the power source to heat up the heating coil as well known in the art. In one embodiment, the temperature of the heating element is controlled within a specific safe range based on a proprietary temperature control algorithm and methodology via the temperature regulating circuit.

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. A compact vaping device with a child proofing mechanism comprising: a casing having a rotatable lid, wherein the casing includes an internal cavity having a front portion; a battery; a heating coil; a co-joined removable mouthpiece and pod configured to attach inside the front portion of the internal cavity, wherein the pod contains a substance configured to be heated via the heating coil turning the substance into a vapor as it passes through the mouthpiece; and, a push-hole forming part of the casing, the push-hole exposing the pod, wherein a predetermined pressure against the pod through the push-hole is required to remove the pod from the casing.

2. The compact vaping device with a child proofing mechanism of claim 1, wherein the casing is round and includes a flat top surface and a flat bottom surface.

3. The compact vaping device with a child proofing mechanism of claim 2, wherein the battery is rechargeable and the combination of the flat bottom surface and the rechargeable battery make the compact vaping device enabled for wireless induction charging.

4. The compact vaping device with a child proofing mechanism of claim 1, wherein the pod is securely held inside the front portion of the casing via a pair of spring loaded tabs frictionally engaged with bulged pads on an outer surface of the pod.

5. The compact vaping device with a child proofing mechanism of claim 4, wherein the predetermined pressure must overcome the engagement of the pair of spring loaded tabs frictionally engaged with the bulged pads for removal of the pod from the casing.

6. The compact vaping device with a child proofing mechanism of claim 1, further comprising a spring loaded plunger on the rotatable lid, wherein the spring loaded plunger is configured to seat inside a cavity positioned on the front portion of the casing.

7. The compact vaping device with a child proofing mechanism of claim 1, wherein the rotation of the rotatable lid is via a hidden revolute joint and the rotation of the rotatable lid must overcome a predetermined retention force to rotate open, wherein the predetermined retention force is the force necessary to remove the spring loaded plunger from the cavity.

8. The compact vaping device with a child proofing mechanism of claim 1, further comprising a communication port configured for charging the battery via a wired means.

9. A compact vaping device with a child proofing mechanism comprising: a round casing having a flat, top surface and a flat bottom surface, wherein the round casing includes an internal cavity having a front portion; a rotatable lid having retention characteristics configured to prevent the rotatable lid from being opened by a child; a battery retained in an internal body, the internal body configured to be positioned inside the internal cavity; a heating coil; a co-joined removable mouthpiece and pod configured to securely attach inside the front portion of the internal cavity, wherein the pod contains a substance configured to be heated via the heating coil turning the substance into a vapor as it passes through the mouthpiece; and, a push-hole forming part of the casing, the push-hole exposing the pod, wherein a predetermined pressure against the pod through the push-hole is required to remove the pod from the casing.

10. The compact vaping device with a child proofing mechanism of claim 9, wherein the retention characteristics include a spring loaded plunger on the rotatable lid, wherein the spring loaded plunger is configured to seat inside a cavity positioned on the front portion of the casing.

11. The compact vaping device with a child proofing mechanism of claim 10, wherein the rotation of the rotatable lid is via a hidden revolute joint and the rotation of the rotatable lid must overcome a predetermined retention force to rotate open, wherein the predetermined retention force is the force necessary to remove the spring loaded plunger from the cavity.

12. The compact vaping device with a child proofing mechanism of claim 11, wherein the retention characteristics further include a set of magnets positioned on the rotatable lid, wherein the set of magnets are in magnetic connection with magnetic elements on the internal body providing an additional predetermined retention force to rotate the rotatable lid open.

* * * * *